US008733472B2

(12) United States Patent
Magnuson

(10) Patent No.: US 8,733,472 B2
(45) Date of Patent: May 27, 2014

(54) MULTI-OPERATIONAL MULTI-DRILLING SYSTEM

(75) Inventor: Christopher Magnuson, Houston, TX (US)

(73) Assignee: Christopher Magnuson, Houston, TX (US)

( * ) Notice: Subject to any disclaimer, the term of this patent is extended or adjusted under 35 U.S.C. 154(b) by 556 days.

(21) Appl. No.: 13/053,582

(22) Filed: Mar. 22, 2011

(65) Prior Publication Data

US 2012/0067642 A1 Mar. 22, 2012

Related U.S. Application Data

(60) Provisional application No. 61/403,248, filed on Sep. 13, 2010, provisional application No. 61/454,867, filed on Mar. 21, 2011.

(51) Int. Cl.
*E21B 7/12* (2006.01)
*E21B 19/00* (2006.01)

(52) U.S. Cl.
USPC ..... 175/7; 166/358; 405/201; 414/22.51

(58) Field of Classification Search
USPC ..... 175/7–9; 166/352, 358, 77.51; 114/264, 114/265; 405/195.1, 201, 223.1; 414/22.51, 414/22.63, 22.66
See application file for complete search history.

(56) References Cited

U.S. PATENT DOCUMENTS 2,628,818 A * 2/1953 Graham ..... 175/9
3,451,493 A * 6/1969 Storm ..... 175/9
3,474,629 A * 10/1969 Woodson ..... 405/201
3,645,103 A * 2/1972 Laffont ..... 405/202
3,657,895 A * 4/1972 Phelps ..... 405/210
3,771,481 A 11/1973 Goren
3,789,921 A * 2/1974 DeChassy et al. ..... 166/351
3,895,677 A * 7/1975 Bokenkamp ..... 166/359
3,981,369 A * 9/1976 Bokenkamp ..... 175/5
3,987,910 A * 10/1976 Brunato ..... 414/22.63
4,044,895 A * 8/1977 Adair ..... 414/22.63
4,065,934 A * 1/1978 Dysarz ..... 405/196
4,444,275 A * 4/1984 Beynet et al. ..... 175/7
4,606,673 A 8/1986 Daniell
4,646,672 A * 3/1987 Bennett et al. ..... 114/264

(Continued)

OTHER PUBLICATIONS

Drilling Equipment Hoisting System (Dual MH Ramrig) (2 pgs.).

(Continued)

*Primary Examiner* — Matthew Buck
(74) *Attorney, Agent, or Firm* — Timothy S. Westby; Porter Hedges LLP

(57) ABSTRACT

A system including a setback and racking system and a set of wellbay accesses, at least a portion of the setback and racking system positioned at an elevation lower than the elevation of the wellbay accesses. A system including a centrally located setback and racking system, a set of wellbay accesses, and at least one peripheral skidding system, wherein the setback and racking system is positioned at least partially below the elevation of the peripheral skidding system. A system including at least one peripheral skidding system and a set of wellbay accesses positioned along a wellbay access perimeter surrounding a central focus that is not an integral part of the peripheral skidding system. A method of drilling by aligning each of at least two drilling modules with a respective wellbay access via a peripheral skidding system and operating at least two drilling modules at least partially simultaneously.

41 Claims, 7 Drawing Sheets

(56) References Cited

U.S. PATENT DOCUMENTS

| | | | | |
|---|---|---|---|---|
| 4,702,321 | A | 10/1987 | Horton | |
| 4,708,563 | A * | 11/1987 | Van Den Berg et al. | 414/22.66 |
| 4,716,972 | A * | 1/1988 | Makinen et al. | 175/8 |
| 4,762,185 | A * | 8/1988 | Simpson | 175/5 |
| 4,819,730 | A * | 4/1989 | Williford et al. | 166/355 |
| 4,899,682 | A * | 2/1990 | Pouget et al. | 114/264 |
| 5,407,302 | A * | 4/1995 | Springett et al. | 405/196 |
| 5,427,180 | A * | 6/1995 | dePaiva Leite et al. | 166/355 |
| 5,762,279 | A * | 6/1998 | Horton, III | 254/285 |
| 6,047,781 | A * | 4/2000 | Scott et al. | 175/5 |
| 6,056,071 | A * | 5/2000 | Scott et al. | 175/5 |
| 6,068,069 | A * | 5/2000 | Scott et al. | 175/5 |
| 6,085,851 | A * | 7/2000 | Scott et al. | 175/7 |
| 6,217,258 | B1 * | 4/2001 | Yamamoto et al. | 405/201 |
| 6,443,240 | B1 * | 9/2002 | Scott | 175/7 |
| 6,488,447 | B1 | 12/2002 | Nish et al. | |
| 6,524,049 | B1 * | 2/2003 | Minnes | 414/22.51 |
| 6,692,193 | B2 * | 2/2004 | Beynet et al. | 405/224.4 |
| 6,763,898 | B1 | 7/2004 | Roodenburg et al. | |
| 6,766,860 | B2 * | 7/2004 | Archibald et al. | 166/341 |
| 7,377,335 | B2 * | 5/2008 | Jones et al. | 175/57 |
| 7,419,006 | B2 | 9/2008 | Armstrong | |
| 8,052,369 | B2 * | 11/2011 | Often et al. | 414/22.55 |
| 8,342,249 | B2 * | 1/2013 | Payne | 166/358 |
| 8,387,704 | B2 * | 3/2013 | Rodrigues | 166/352 |
| 8,522,880 | B2 * | 9/2013 | Roodenburg et al. | 166/339 |
| 2009/0025937 | A1 * | 1/2009 | Robinson et al. | 166/351 |
| 2010/0038088 | A1 * | 2/2010 | Springett et al. | 166/313 |
| 2010/0108322 | A1 * | 5/2010 | Eilertsen | 166/352 |
| 2011/0017511 | A1 | 1/2011 | Payne | |
| 2011/0265701 | A1 | 11/2011 | Murray | |
| 2012/0067642 | A1 | 3/2012 | Magnuson | |
| 2012/0125250 | A1 | 5/2012 | Murray | |

OTHER PUBLICATIONS

The ABCD of Smarter Spar Drilling (Offshore Engineer) Dec. 2010 (6 pgs.).

Aker H-6e Drilling Semi Submersible for Deep Water and Harsh Environment, Pal Lindstad (Mar. 29, 2006 (11pgs).

International Preliminary Report on Patentability dated Mar. 19, 2012 for corresponding International Application No. PCT/US2011/029426 (4 pgs.).

Cause No. 2011-54420 "FLOATEC's First Amended Original Petition and Request for Disclosure", disclosed pursuant to MPEP 2001.06(c), related litigation, dated Aug. 13, 2012 (12 pgs.).

International Search Report and Written Opinion dated Aug. 29, 2011 for corresponding International Application No. PCT/US2011/029426 (8 pgs.).

U.S. Office Action dated Dec. 11, 2012 for U.S. Appl. No. 13/052,585 (9 pgs.).

U.S. Office Action dated Sep. 20, 2012 for U.S. Appl. No. 12/979,440 (6 pgs.).

U.S. Office Action dated Dec. 10, 2012 for U.S. Appl. No. 12/979,440 (5 pgs.).

Murray, John James; U.S. Provisional Application dated Nov. 24, 2010 for U.S. Appl. No. 61/417,064 (16 pgs.).

Murray, John James; U.S. Provisional Application dated Apr. 28, 2010 for U.S. Appl. No. 61/328,889 (13 pgs.).

* cited by examiner

MULTI-OPERATIONAL MULTI-DRILLING SYSTEM

CROSS-REFERENCE TO RELATED APPLICATIONS

This application claims the benefit under 35 U.S.C. §119 (e) of U.S. Provisional Patent Application No. 61/454,867, filed Mar. 21, 2011, and U.S. Provisional Patent Application No. 61/403,248, filed Sep. 13, 2010, the disclosures of each of which are hereby incorporated herein by reference.

STATEMENT REGARDING FEDERALLY SPONSORED RESEARCH OR DEVELOPMENT

Not Applicable.

BACKGROUND

1. Field of the Invention

The present disclosure relates generally to a multi-operational system for use in petroleum exploration and development. More particularly, the present disclosure relates to a drilling system comprising a peripheral skidding system and/or a removed, lowered, and centrally located setback and racking system to enable a plurality of operations, such as, but not limited to, offline stand building and racking of tubulars, workover, and drilling operations, to be performed concurrently.

2. Background of the Invention

Offshore production of oil and gas requires the use of offshore drilling, completion, and workover rigs. These drilling, completion, and workover rigs are used in different phases of operation for the exploration and production of oil and gas. Offshore rig operations require a vast amount of manpower and the cost of operating these rigs is substantial. The rigs comprise systems for, among other operations, lifting and handling of loads, rotating of tubulars, power generation, circulation of fluids, monitoring of down hole activity, and maintenance of well control and safety.

Conventional systems comprise drilling equipment used in offshore activity for lifting and moving loads, rotating and handling of tubulars (e.g., drill pipe, drill collars, logging tools, casing, etc.), and assembling of tubulars (e.g., connecting multiple pieces of pipe in an end-to-end manner, etc.) prior to lowering the multi-piece unit into the well bore), assembling pipe and equipment, disassembling pipe and equipment, lowering pipe and equipment to the sea floor, and inserting components into the wellbore, and are also used in recovery operations. The systems are also used in drilling, completion, and workover operations.

When drilling operations are conducted in deep water, greater costs and logistical challenges can be confronted relative to operations in shallower waters. A major cost associated with drilling and producing a well is the cost of leasing the platform and associated equipment. Each day of rig time can cost hundreds of thousands of dollars. Accordingly, it is desirable to plan and design drilling operations to operate as efficiently as possible. The increased costs are compounded, for example, by the additional time required to deal with the challenges of operating in deep waters, and the make-up and break-out of tubulars during a drilling operation.

Operations for lifting and moving loads, for rotating and handling tubulars, and for drilling generally occur in the rig floor area. The rig floor area is positioned over the wellbays. Since the standard wellbay design is established in a matrix or grid format (e.g., a 4×4 layout), access to the wellbays below the rig floor is restricted by such designs. Therefore, due to the limited access to the wellbays, such a matrix format typically allows for only a single rig function (e.g., an active drilling derrick/mast, a workover operation, a wireline operation, a coiled tubing operation, etc.) to take place at a time. For example, the running of a drilling riser generally precludes the building of stands on a rig of standard design, thus relegating the first trip into the well bore to utilizing singles for tubulars.

Additionally, to assist the efficient handling thereof, tubulars are typically assembled and stacked vertically in an area within the rig floor known as the setback.

The racking of tubulars in the derrick or mast of the rig may undesirably act as a sail, imparting excessive wind loading forces onto the rig during inclement weather. In gusting wind conditions, for example, so-designed prior art rigs can thus be adversely affected by the resulting dangerous motions and dynamics caused by the impact of the wind on the setback within the derrick or mast. The mass, wind resistance, etc., imparted to the rig by the positioning of tubulars in an elevated setback normally mandates the removal and dismantling of such tubulars during high wind (e.g., hurricane) conditions.

The current industry standard of locating the setback and the derrick or mast within/on the rig floor requires a high level of complexity and automation, and undesirably provides that numerous activities take place overhead of the drilling crew. A serious cause of injury to, or even fatality of, offshore drilling rig workers is the falling of objects dropped from above the rig floor.

Traditionally, offshore wellbores are formed (e.g., drilled and completed) using a single load path (e.g., derrick, rig, drilling assembly), thus mandating that all wellbore tasks (e.g., drilling, completion, stimulations, workovers, etc.) be performed from a single drilling assembly. Recently, efforts have been made to decrease the time required to drill offshore wells by performing some tasks simultaneously. For example, U.S. Pat. Nos. 6,085,851 and 6,056,071 to Scott et al. disclose a multi-activity apparatus and method for conducting drilling operations. In general, Scott et al. disclose a drilling platform having dual drilling assemblies (e.g., separate load paths and/or derricks). In the method disclosed in Scott et al., some activities during the top hole drilling phase and the post drilling phase are performed substantially simultaneously by a main derrick and an auxiliary derrick.

U.S. patent application Ser. No. 12/840,658 describes a method for drilling an offshore wellbore into the seabed from a platform positioned proximate the water surface. The disclosed method comprises making up a first tubular string with a first conveyance assembly and running the first tubular string into the wellbore with the first conveyance assembly, and, while performing a wellbore task with the first tubular string, making-up a second tubular string from a second conveyance assembly, withdrawing the first tubular string from the wellbore with the first conveyance assembly once the wellbore task is completed, and running the second tubular string with the second conveyance assembly into the wellbore. Such a system enhances the speed at which wellbore tasks can be completed, but does not enable multiple wellbays to be serviced simultaneously and limits operations to two activities.

U.S. Pat. No. 4,444,275 to Beynet et al. discloses a carousel for a vertically moored platform. The disclosed carousel rotates about a central support post such that a drilling apparatus can be guided thereby from an anchored drilling vessel or tethered platform above a drilling template placed on the sea floor. Beynet et al. do not address the issues created by positioning a setback on the drilling floor in a drilling rig with regards to safety, wind loading and dynamics associated with the high CG (center of gravity) of the setback.

Accordingly, there remains a need for a drilling system that addresses the significant problems associated with the limitations of a matrix drilling format, the excessive wind loading forces that must be dealt with as a result of conventional racking of tubulars within a drilling rig, and/or improves the safety of workers on a rig by limiting the quantity and types of objects that are elevated and handled above the rig floor. Desirably, such a system provides for improvements in drilling performance, safety, and/or hurricane evacuation response. Improvements in drilling performance can include a reduction in the time required to drill and/or complete a wellbore, for example, by more efficient utilization of the rig floor of a platform rig assembly to enable multiple activities or operations, including exploration and/or production operations as well as completion, testing, workover, and maintenance operations to be performed more efficiently. Improvements in safety and/or hurricane evacuation response can be provided by eliminating the use of or the need for some physical equipment (e.g., a setback located on the rig floor and elevated within a drilling rig) traditionally required to conduct offshore drilling operations. Such an improved drilling system is also desirably more efficient than conventional drilling systems, providing for reduced costs associated with leasing capital drilling equipment, and/or lowered design costs for new drilling rigs.

SUMMARY

Herein disclosed is a system comprising a setback and racking system, and a first set of wellbay accesses positioned along a wellbay access perimeter, wherein each of the first set of wellbay accesses is associated with a wellbay substantially therebelow, wherein at least a portion of the setback and racking system is positioned at an elevation lower than the elevation of the wellbay accesses, and wherein the setback and racking system is configured to feed tubulars in the direction of a plurality of the wellbays.

In embodiments, the system comprises at least three wellbay accesses. In embodiments, the wellbay access perimeter is substantially triangular. In embodiments, the system comprises at least four wellbay accesses. In embodiments, the wellbay access perimeter is substantially rectangular. In embodiments, the wellbay access perimeter is substantially a shape selected from the group consisting of triangular, rectangular, circular, oval, and octagonal. In embodiments, the wellbay access perimeter substantially surrounds the setback and racking system.

The system can further comprise at least two operating drilling modules selected from the group consisting of standbuilding systems, wireline units, coiled tubing units, workover systems, intervention units, and drilling rigs. In embodiments, the at least two operating drilling modules comprise a drilling rig and the drilling rig does not comprise a setback and racking system. The drilling rig can comprise a mast. In embodiments, the system comprises no derrick.

In embodiments, the system further comprises at least one peripheral skidding system operable to serially position a drilling module above at least a fraction of the first set of wellbays. In embodiments, the system comprises a first peripheral skidding system operable to serially position a drilling module above at least a fraction of the first set of wellbays and a second peripheral skidding system operable to serially position a drilling module above at least another fraction of the first set of wellbays. In embodiments, the at least one peripheral skidding system comprises at least two rails positioned substantially equidistantly apart, each of the at least two rails defining a skidding perimeter surrounding the setback and racking system.

In embodiments, the system further comprises a second set of wellbay accesses positioned along a second wellbay access perimeter, each of the second set of wellbay accesses associated with a wellbay substantially therebelow. Such a system can further comprise at least one peripheral skidding system operable to serially position a drilling module above at least a fraction of the first set of wellbays, at least a fraction of the second set of wellbays or at least a fraction of the first and second sets of wellbays. In embodiments, the system comprises at least two peripheral skidding systems, a first peripheral skidding system operable to serially position a drilling module above at least a fraction of the total wellbays comprising the first and second sets of wellbays and a second peripheral skidding system operable to serially position a drilling module above at least another fraction of the total wellbays. In embodiments, the second set of wellbay accesses is radially staggered relative to the first set of wellbay accesses.

In embodiments, the wellbay accesses are located in the upper deck of a drilling platform. The drilling platform can be selected from the group consisting of fixed platforms, compliant towers, tension leg platforms (TLP's), spars, semi-submersibles, floating drilling, production, storage and offloading facilities (FDPSO's), drill ships, and modified mobile offshore drilling units (MODU's).

Also disclosed herein is a system comprising a centrally located setback and racking system, a set of wellbay accesses positioned substantially equidistantly apart from each other along a wellbay access perimeter, each of the plurality of wellbay accesses associated with a wellbay substantially therebelow, at least one peripheral skidding system located on a main deck of a drilling platform, the at least one peripheral skidding system operable to position a plurality of drilling modules with a plurality of the wellbay accesses and the centrally located setback and racking system positioned at least partially below the elevation of the peripheral skidding system, and the centrally located setback and racking system configured for rotational movement about its center of axis to feed tubulars in substantially the direction of each of the plurality of wellbay accesses. In embodiments, the wellbay access perimeter at least substantially surrounds the centrally located setback and racking system. The system can further comprise a plurality of drilling modules selected from the group consisting of drilling rigs, workover rigs, wireline units, offline standbuilding systems, and combinations thereof. In embodiments, the plurality of drilling modules are selected from the group consisting of drilling rigs, workover rigs, wireline units, offline standbuilding systems, and combinations thereof. In embodiments, the system comprises at least one drilling rig and at least one coiled tubing unit. In embodiments, the system comprises at least two drilling rigs. The drilling platform can be selected from the group consisting of fixed platforms, compliant towers, tension leg platforms (TLP's), spars, semi-submersibles, floating drilling, production, storage and offloading facilities (FDPSO's), drill ships, and modified mobile offshore drilling units (MODU's).

Also disclosed herein is a system comprising a set of wellbay accesses positioned substantially equidistantly apart from each other along a wellbay access perimeter surrounding a central focus, each of the plurality of wellbay accesses associated with a wellbay substantially therebelow, and at least one peripheral skidding system comprising at least two spaced-apart rails defining a skidding perimeter and a plurality of skids and operable to align each of the plurality of skids proximate a desired wellbay access, wherein the central focus is not an integral part of the peripheral skidding system. In embodiments, the central focus comprises a setback and racking system configured to feed tubulars in substantially the direction of each of the plurality of wellbay accesses. In embodiments, the peripheral skidding system is located on a main deck of a drilling platform and the setback and racking system is positioned at least partially below the main deck. Each of the plurality of skids can comprise equipment selected from the group consisting of equipment for drilling, workover, wireline, offline standbuilding, and combinations thereof.

Also disclosed herein is a method of drilling, the method comprising aligning each of at least two drilling modules with a respective wellbay access via a peripheral skidding system operable to position a plurality of drilling modules proximate a plurality of wellbay accesses, wherein the plurality of wellbay accesses is aligned in a wellbay access perimeter and wherein each wellbay access is associated with a wellbay substantially therebelow, and operating the first of the at least two drilling modules to perform a first operation and the second of the at least two drilling modules to perform a second operation, wherein at least a portion of the first and second operations are performed simultaneously. In embodiments, the first and second operations are selected from the group consisting of drilling operations, workover operations, intervention operations, and offline standbuilding operations. In embodiments, at least one of the first and second operations is selected from the group consisting of wireline, slickline, and coiled tubing. In embodiments, at least one of the first and second drilling modules comprises a drilling rig. In embodiments, the drilling rig does not comprise a setback. In embodiments, the method comprises aligning each of at least three drilling modules. In embodiments, the peripheral skidding system is located on a drilling platform selected from the group consisting of fixed platforms, compliant towers, tension leg platforms (TLP's), spars, semi-submersibles, floating drilling, production, storage and offloading facilities (FDPSO's), drill ships, and modified mobile offshore drilling units (MODU's). In embodiments, the peripheral skidding system is located on a main deck of the drilling platform and the setback and racking system is positioned at least partially below the main deck. In embodiments, the wellbay access perimeter at least substantially surrounds a central setback and racking system. In embodiments, the method comprises feeding tubulars to at least one of the drilling modules via the central setback and racking system. The method can further comprise feeding tubulars to at least one of the other drilling modules via the central setback and racking system. In embodiments, the method further comprises aligning at least one of the at least two drilling modules with a different wellbay access via the peripheral skidding system, aligning at least one additional drilling module with a wellbay access, or both, and feeding tubulars to at least one of the at least two drilling modules, the additional modules, or both, via the setback and racking system.

In embodiments, at least one operation selected from the group consisting of the first operation and the second operation comprises running a dry tree through at least one of the plurality of wellbay accesses. In embodiments, at least one operation selected from the group consisting of the first operation and the second operation comprises running a wet tree through at least one of the plurality of wellbay accesses. In embodiments, at least one operation selected from the group consisting of the first operation and the second operation comprises running a surface stack BOP through at least one of the plurality of wellbay accesses. In embodiments, at least one operation selected from the group consisting of the first operation and the second operation comprises running a subsea stack BOP through at least one of the plurality of wellbay accesses.

BRIEF DESCRIPTION OF THE DRAWINGS

For a more detailed description of the various embodiments of the present disclosure, reference will now be made to the accompanying drawings, wherein.

NOTATION AND NOMENCLATURE

Figure 1B:
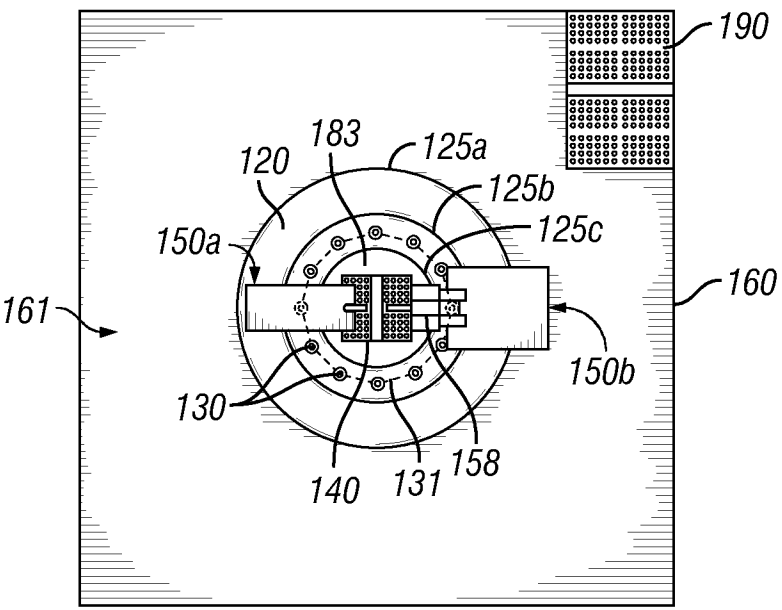
FIG. 1*b* is a top view of the multi-operational drilling system of FIG. 1*a;*

It is to be understood that the following disclosure provides many different embodiments, or examples, for implementing different features of various embodiments of the invention. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the term 'perimeter' refers to a path that surrounds an area. It is to be understood that a perimeter may be of any shape, such as, but not limited to, triangular, rectangular, octagonal, square, circular, oval, trapezoidal, pentagonal, hexagonal, and so on.

As used herein, the term 'around' means 'forming a perimeter surrounding' and does not necessarily imply that said perimeter is circular in shape. Similarly, the term 'circumference' may be used generally herein to mean a perimeter as defined above and may not necessarily imply that said perimeter is round or substantially round.

As used herein, the word 'fixed' in reference to the 'fixed setback and racking system' means that the setback and racking system is substantially centrally located with regard to the wellbay accesses. Although referred to as 'fixed', it is to be understood that, depending on the perimeter geometry, the setback and/or racking system may be configured to skid to ensure alignment with a particular drilling module.

As used herein, the terms 'up' and 'down'; 'upper' and 'lower'; 'top' and 'bottom'; and other like terms indicating relative positions to a given point or element are utilized in efforts to more clearly describe some elements.

The term 'tubular' as used herein can mean any type of pipe, unless specifically stated otherwise. The terms may be used in combination with 'joint' to mean a single unitary length, or a 'string' meaning two or more interconnected joints.

The term 'lowered' as used with 'lowered setback and racking system' is used to indicate that the setback and racking system according to this disclosure is not an integral part of a mast or derrick. Although not always the case, a lowered setback of this disclosure may also be, in embodiments, 'lowered' in relation to the drill floor, i.e. positioned at least partly or wholly below the drill floor.

'Drilling module' is utilized herein to mean an assembly which is suitable to perform any operation or operations associated, even in an ancillary manner, with the drilling and servicing of wellbores. For example, an offline standbuilding apparatus is considered a 'drilling module' according to this disclosure, as it is utilized to support drilling operations.

DETAILED DESCRIPTION

Overview.

Herein disclosed is a multi-operational drilling system (hereinafter, 'MODS') or multi-operational wellbore forming system for performing multiple operations associated with drilling. Also disclosed herein is a method of drilling and/or servicing a plurality of wellbores (for example wellbores in the seafloor), utilizing the disclosed multi-operational drilling system. The herein disclosed multi-operational peripheral drilling system and method enable the advancement of oil, gas and water wellbore drilling, completion, wireline, coil tubing, and/or workover operations, by allowing multiple operations associated with drilling to be completed simultaneously, with greater safety than conventional drilling systems that employ drilling rigs comprising elevated rig floor and setback and racking systems and/or centralized drilling (as opposed to the herein disclosed peripheral drilling).

In embodiments, an MODS of this disclosure comprises a substantially centralized setback and racking system and a set of wellbay accesses (also referred to herein as wells slots, slots, or bays) positioned along a perimeter substantially surrounding the setback and racking system. An MODS of this disclosure can further comprise one or more peripheral skidding systems and/or one or more drilling modules (also referred to herein as drilling systems or skids), and/or can be integrated onto a platform from which wellbore tasks (e.g., operations) are performed, as discussed further hereinbelow. It is to be understood that, although the MODS described in this disclosure are well-suited for, and will be described with respect to, offshore drilling of subterranean regions, as discussed further hereinbelow, an MODS of this disclosure may also be desirable for drilling of subterranean regions onshore.

In embodiments, the multi-operational system of this disclosure comprises a centrally located and lowered setback and racking system for the tubular movement and storage (e.g., vertical storage) of tubulars (e.g., drill pipe, casing, etc.) The MODS can further comprise one or more equipment skid systems arranged on a peripheral skidding system whose focus is the lowered setback and racking system. As further elaborated hereinbelow, the herein described lowering of the setback and racking system can provide a lowered platform center of gravity, thereby increasing overall platform stability. Via the disclosed system and method, drilling equipment can be positioned down inside the structure (e.g., the hull), rather than on the top deck.

In embodiments, an MODS of this disclosure comprises a peripheral skidding system, configured for rotational positioning of various types of equipment used in drilling, workover, wireline, and offline standbuilding operations. More specifically, such a peripheral skidding system comprises a peripheral skid that is integrated into the floor of the platform and is used to provide for outer peripheral, rotational repositioning of, for example, derricks, masts, wireline equipment, and coiled tubing equipment, over a plurality of wellbays arranged in a perimeter rather than conventional matrix format. The herein disclosed peripheral skidding system and the use thereof replaces the conventionally known central, matrix method of lowering equipment into centralized wellbay(s). As discussed in greater detail hereinbelow, the disclosed peripheral skidding system enables multiple simultaneous operations to take place. The various rig operations (i.e. drilling, workover, wireline, coiled tubing, etc.) may be performed on multiple wellbores (i.e. oil, gas, and water well bores) singularly or simultaneously from multiple independent equipment skids (also referred to herein as skid systems or skids) arrayed in a peripheral fashion along the peripheral skidding system. The peripheral skidding system is, in embodiments, integrated with a centrally located and lowered setback and racking system having access to at least a plurality of the wellbores.

Upon reading this disclosure, it will become apparent to those of skill in the art that the herein disclosed separation of the setback and racking system from the derrick or mast of a drilling rig or module, the lowering of the setback and racking system, and/or the utilization of a peripheral skidding system forming a perimeter centered about a centrally-located setback and racking system provide for significant enhancements in drilling performance, economy and safety.

The Figures referred to hereinbelow illustrate the features and advantages of the multi-operational system of this disclosure. The equipment illustrated in FIGS. 1-6 is non-limiting and one of ordinary skill in the art will appreciate that many other types and combinations of equipment can be incorporated into embodiments of the system and that some of the equipment indicated in the Figures is optional and can thus, in embodiments, be absent from the system without departing from the scope or spirit of the present disclosure.

Multi-Operational Drilling System.

Figure 1A:
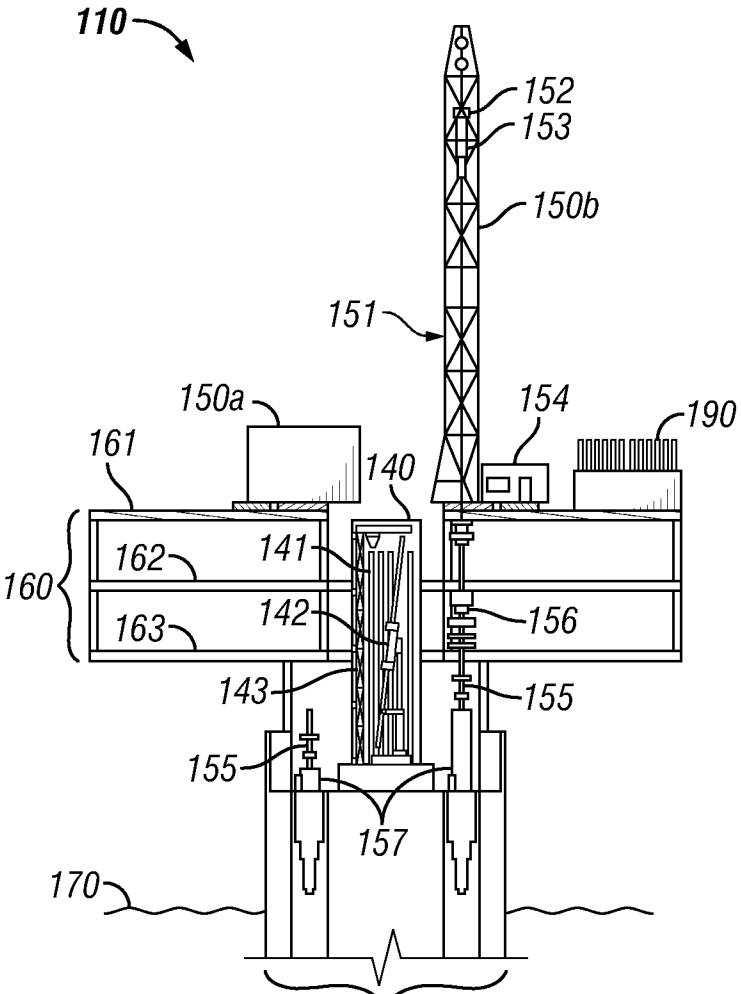
FIG. 1*a* is a side view elevation of a multi-operational drilling system according to an embodiment of this disclosure, the multi-operational drilling system comprising a first drilling module, a second drilling module, and a lowered setback and racking system.

Description of an MODS of this disclosure will now be made with reference to FIG. 1*a*, which is a side elevation view of a drilling system 110 according to an embodiment of this disclosure, and FIG. 1*b*, which is a top view of multi-operational drilling system 110. Multi-operational drilling system 110 comprises wellbay accesses 130 positioned along a perimeter 131 (see FIG. 1*b*), each wellbay access associated with a wellbay substantially therebelow. In the embodiment of FIGS. 1*a* and 1*b*, MODS system 110 further comprises fixed and centralized setback and racking system 140, about which the wellbay access perimeter is substantially centered, peripheral skidding system 120, first operational drilling module 150*a*, and second operational module 150*b* and is integrated onto drilling platform 160. Each of the components of MODS 110 will be discussed in more detail hereinbelow.

Wellbay Accesses 130.

System 110 comprises a plurality of wellbay accesses 130. Wellbay accesses 130 are positioned along a perimeter 131. In embodiments, the perimeter delineated by wellbay accesses 130 at least partially surround a centrally located and fixed setback and racking system 140, as described further hereinbelow. Each of the wellbay accesses 130 is associated with a wellbay located substantially therebelow. Perimeter 131 can take any suitable shape as dictated by the desired wellbore drilling pattern. The perimeter pattern should take into account the number of wellbores to be drilled and the available drilling area, in order to provide efficient utilization of platform space. In embodiments, the perimeter defined by the wellbay accesses is, by way of non-limiting examples, substantially triangular, rectangular (e.g., square), oval, circular, octagonal, hexagonal, or pentagonal. The shape defined by the perimeter is not limited. The positioning of the wellbay accesses along a perimeter (e.g., a perimeter surrounding, but not necessarily in a circular manner, a lowered setback, and racking system 140) provides significant benefits relative to the traditional X-Y systems, in which approach to the various wellbay accesses is restricted/limited. In embodiments, the MODS comprises at least three wellbay accesses. In embodiments, the perimeter is substantially triangular. In embodiments, the MODS comprises at least four wellbay accesses. In embodiments, the perimeter is substantially rectangular. In embodiments, the perimeter is substantially triangular, rectangular, circular, oval, or octagonal.

The wellbay accesses can be any size or shape suited for a desired application. In embodiments, the wellbays and/or wellbay accesses are large enough for the lowering and manipulation of larger equipment such as, but not limited to, blowout preventers into and/or through the wellbay. In embodiments, one or more wellbay accesses of a MODS of this disclosure is sized such that a dry tree, a wet tree, a surface stack blowout preventer (BOP) and/or a subsea stack BOP can be run therethrough.

Figure 2A:
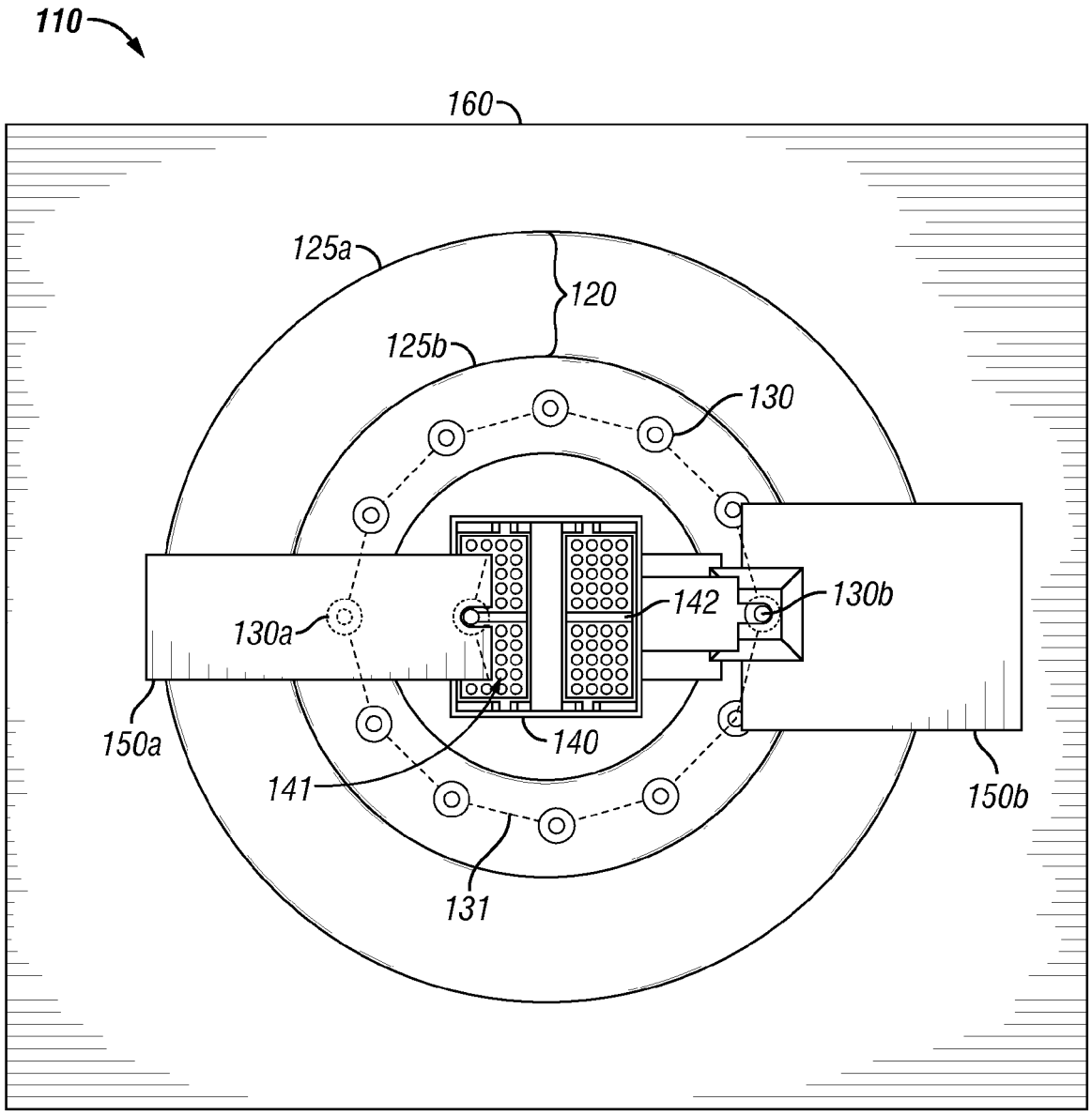
FIG. 2*a* is a top view of a multi-operational drilling system according to this disclosure, the multi-operational drilling system comprising a peripheral skid system, a first drilling module, a second drilling module, a lowered setback, a racking system, and a plurality of wellbay accesses positioned circumferentially around a plurality of wellbay accesses.

In embodiments, the wellbay accesses are positioned in a substantially circular perimeter. For example, as indicated in FIG. 2*a*, which is an enlarged top view of the MODS of FIGS. 1*a*/1*b*, an MODS of this disclosure can comprise a plurality of wellbay accesses 130 positioned along a perimeter 131 that is substantially circular. In the embodiment of FIG. 2*a*, the wellbay access perimeter surrounds lowered setback and racking system 140. The system can further comprise a peripheral skid system 120, a first drilling module 150*a* and a second drilling module 150*b*.

Figure 2B:
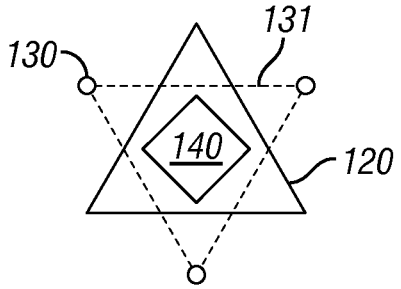
FIG. 2*b* is a top view of a multi-operational drilling system according to another embodiment of this disclosure wherein the wellbay accesses are positioned along a substantially triangular perimeter.

In embodiments, the wellbay accesses are positioned in a substantially triangular perimeter (e.g., substantially around central setback and racking system). FIG. 2*b* is a top view of an MODS according to another embodiment of this disclosure wherein the wellbay accesses 130 are positioned along a substantially triangular perimeter 131 surrounding a lowered setback and racking system 140.

Figure 2C:
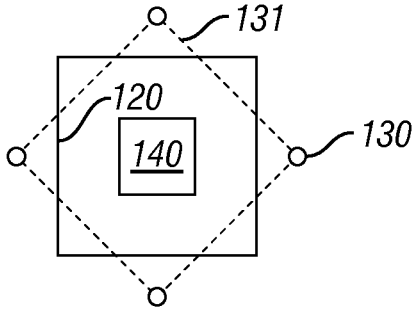
FIG. 2*c* is a top view of a multi-operational drilling system according to another embodiment of this disclosure wherein the wellbay accesses are positioned along a substantially rectangular perimeter.

In embodiments, the wellbay accesses are positioned in a substantially rectangular perimeter (e.g., substantially surrounding central setback and racking system). FIG. 2*c* is a top view of an MODS according to an embodiment of this disclosure wherein wellbay accesses 130 are positioned along a rectangular perimeter 131 substantially surrounding a lowered setback and racking system 140.

Figure 2D:
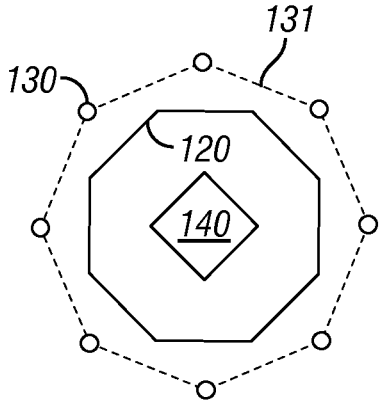
FIG. 2*d* is a top view of a multi-operational drilling system according to another embodiment of this disclosure wherein the wellbay accesses are positioned along a substantially octagonal perimeter.

In embodiments, the wellbay accesses are positioned about a substantially octagonal perimeter (e.g., substantially surrounding central setback and racking system). FIG. 2*d* is a top view of an MODS according to an embodiment of this disclosure wherein wellbay accesses 130 are positioned along a substantially octagonal perimeter surrounding a lowered setback and racking system 140.

Figure 2E:
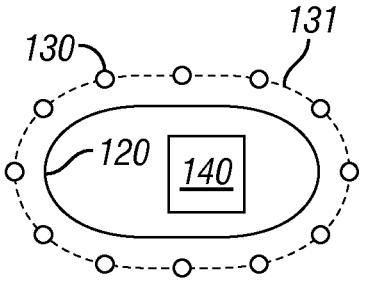
FIG. 2*e* is a top view of a multi-operational drilling system according to another embodiment of this disclosure wherein the wellbay accesses are positioned along a substantially oval perimeter.

In embodiments, the wellbay accesses are positioned about a substantially oval perimeter (e.g., around a central setback and racking system). FIG. 2*e* is a top view of an MODS according to an embodiment of this disclosure wherein wellbay accesses 130 are positioned along a substantially oval perimeter 131 surrounding a lowered setback and racking system 140.

The MODS of this disclosure can comprise a number of sets of wellbay accesses, each set of wellbay accesses positioned substantially along a perimeter, wherein each of the wellbay accesses is associated with a wellbay substantially therebelow. For example, in embodiments, an MODS of this disclosure further comprise a second set of wellbay accesses positioned substantially along a second perimeter (that may surround a lowered setback and racking system), wherein each of the second set of wellbay accesses is associated with a wellbay substantially therebelow.

Figure 2F:
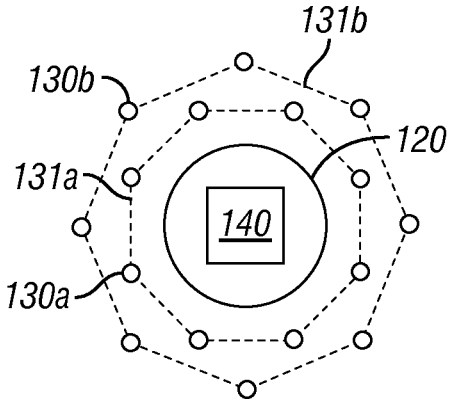
FIG. 2*f* is a top view of a multi-operational drilling system according to another embodiment of this disclosure wherein first and second sets of the wellbay accesses are radially offset and positioned along substantially circular perimeters.

In embodiments, an MODS of this disclosure comprises more than one set of wellbay accesses, with each set of wellbay accesses defining a perimeter around a central setback and racking system. In embodiments, sets of wellbay accesses are radially staggered relative to the other sets of wellbay accesses, allowing easy access thereto by a centralized setback and racking system. For example, in FIG. 2*f* a first set of wellbay accesses 130*a* is positioned about a substantially octagonal perimeter around a central setback and racking system 140 and a second set of wellbay accesses 130*b* is also positioned about a substantially octagonal perimeter around setback and racking system 140. Each set of wellbay accesses 130*a*/130*b* defines a perimeter about the setback and racking system 140. In the embodiment of FIG. 2*f*, the first and second sets of wellbay accesses are positioned on substantially circular perimeters surrounding a lowered setback and racking system 140. Each of the embodiments in FIGS. 1*a*-1*d* could comprise any number of sets of wellbay accesses aligned in perimeters. The perimeters can substantially surround a centralized setback and racking system. The various sets of wellbay accesses can be aligned in a perimeter of the same or different shape from every other set of wellbay accesses. In embodiments, a second set of wellbay accesses defines a perimeter of a different shape than a first set of wellbay accesses. In embodiments, first and second sets of wellbays define perimeters of like shape and different dimension. For example, it is envisioned that an MODS of this disclosure could comprise a first set of wellbay accesses aligned about a circular perimeter and a second set of wellbay accesses aligned about a substantially rectangular perimeter, each of which may substantially surround setback and racking system 140. That is, the perimeters defined by the wellbay accesses in embodiments comprising a plurality of sets of wellbay accesses can have the same or different shapes from the other sets of wellbay accesses.

The wellbay accesses 130 can be located on a drilling platform 160, as further discussed hereinbelow. In embodiments, the wellbay accesses are positioned on an upper deck 161 of a drilling platform.

Lowered Setback and Racking System 140.

In embodiments, an MODS of this disclosure comprises a lowered and 'fixed' setback and racking system 140. The setback and racking system is 'lowered' relative to conventional setbacks and racking systems, which are typically integrated into the rig floor, for example, in a derrick of a drilling rig, with the setback located on the drill floor with the racking equipment integrated into the derrick and located high above the drilling floor. The setback and racking system of this disclosure is separate and lowered from the drill floor, i.e. in the sense that it is positioned substantially central to the system, with regard to the wellbays, which form a perimeter substantially therearound, as will be further discussed hereinbelow. The setback and racking system is thus configured to move (e.g., be positioned) and/or rotate separate from a drilling module, thus enabling the setback and racking system to align with a desired drilling module and associated wellbay. The lowered setback and racking system of this disclosure allows for rotation and/or movement to allow for alignment with a drilling module(s) and support for tubular handling and racking. The disclosed setback and racking system is separate and/or lowered from the drill floor/rig floor. Via such a design, the central setback and racking system according to embodiments of this disclosure is configured to feed tubulars in the direction of each of the plurality of wellbays/wellbay accesses. In embodiments, at least a portion of centralized setback and racking system 140 is positioned at an elevation below that of wellbay accesses 130.

As mentioned hereinabove, the term 'lowered' as used with 'lowered setback and racking system' is used to indicate that the setback and racking system according to this disclosure is not an integral part of a mast or derrick. Although not always the case, a lowered setback of this disclosure may also be, in embodiments, 'lowered' in relation to the drill floor, i.e. positioned at least partly or wholly below the drill floor. In embodiments, the setback is lowered up to 160 feet from traditional setback positioning in the derrick of a drilling rig. However, it will be apparent to those of skill in the art that embodiments of the disclosed system can comprise a (e.g., limited or reduced size) setback within a mast/derrick in combination with a lowered setback and racking system as disclosed herein.

Lowered setback and racking system 140 is configured to handle, prepare and rack tubulars and to feed tubulars to drilling modules working above the wellbays. In embodiments, at least part of a setback and racking system 140 is positioned at an elevation lower than the elevation of upper deck 161 of the wellbay accesses 130, as can be seen in the embodiment of FIG. 1. Wellbay accesses 130 are positioned along the top of upper or main deck 161. The setback and racking system 140 is positioned wholly or partially below the top of upper deck 161. The lowered setback and racking system 140 can be positioned within a drilling platform 160, such platforms known in the art and further discussed hereinbelow.

Incorporation of a lowered setback and racking system that is disassociated from the drilling rig lowers the center of gravity of the drilling platform relative to traditional platforms comprising setback and racking systems positioned high in the derrick. This lowering of the center of gravity of the platform serves to enhance the stability of the platform.

Centralized and lowered setback and racking system 140 of the multi-operational drilling system of embodiments of this disclosure allows for tubular handling to safely and efficiently supply drilling system(s) or modules with tubulars. The lowered setback and racking system provides for improvement in the safety on the offshore rig by removing the racking system from overhead of the driller's cabin 154 and drill floor 158. Additionally, the lowering of the setback and racking system within the deck (e.g., within an open central spar of a spar-type platform), prevents or minimizes resistance provided by the (e.g., vertically) racked tubulars by effectively sheltering the tubulars from exposure to the wind.

The setback and racking system is operable to perform racking and pipe handling operations and can comprise various pipe handling equipment as known to those of skill in the art. For example, the setback and racking system can comprise one or more areas 141 for storing of tubulars. The setback and racking system can combine one or more areas configured for substantially horizontal stacking of tubulars, one or more areas configured for substantially vertical storing of tubulars, one or more areas configured for substantially diagonal storing of tubulars or a combination thereof. Centralized setback and racking system 140 comprises one or more conveyance assemblies 142 (e.g., hoisting system or apparatus, load path) for feeding tubulars to a drilling module 150 on a skid (that may be positioned by a peripheral skidding system 120) on the main deck 161. In embodiments, the setback and racking system 140 comprises one or more pipe handling systems 142 configured to receive a tubular from the pipe storage area(s) 141 and feed it to a drilling module 150*a*/150*b* positioned over a wellbay access 130. The pipe racking system of setback and racking system 140 is also made to accept tubular being fed to the pipe handling system 142 from the an offline standbuilding module 150*a* or the reverse for breaking down tubular. The one or more pipe feeding systems 142 are integrated into the lowered setback and racking system, and the lowered setback and racking system is configured for movement, enabling the pipe feeding system to feed tubulars in a number of directions and align with the drilling module and/or offline standbuilding system or other skidding system. In embodiments, the pipe feeding system(s) is operable to feed tubulars in 360 degrees (i.e. the pipe handling apparatus can feed tubulars in any direction through movement, either rotational or directional of the lowered setback and racking system). In embodiments, the pipe feeding or 'handling' system comprises one or more pipe chutes, as known in the art. In embodiments, a plurality of pipe handling system is employed. In such embodiments, a first pipe feeding system (e.g., a first pipe handling chute) may be operable to feed tubulars to drilling modules located on one side of the upper deck and a second pipe handling chute may be operable to feed tubulars to drilling modules located on the other side of the upper deck. In such instances, such pipe feeding systems can be integrated into the lowered setback and racking system allowing for pipe feeding support for 360 degrees (e.g., 180 degree rotation in certain embodiments). Desirably, however, the setback and racking system comprises redundancy in pipe handling apparatus. For example, it may be desirable for the lowered setback and racking system to comprise at least two pipe feeding systems such that, should one need repair or maintenance, the other one can be utilized. In view of this, it may be desirable to employ at least two pipe feeding systems (e.g., with each pipe chute being rotatable 360 degrees.) In such embodiments, a first pipe feeding system can be utilized to feed tubulars to drilling module(s) on a first side of the upper deck (for example from a first pipe storage area on a first side of the setback) and a second pipe feeding system can be utilized to feed tubulars to drilling module(s) on a second side of the upper deck. Should one of the pipe feeding systems need to go down for any reason, the remaining pipe feeding system can be rotated about and operated to feed tubulars to the drilling modules on both sides of the upper deck.

Although the setback and racking systems 140 depicted in the Figures comprise one or more conveyance assemblies 143, one or more pipe handling systems 142, and pipe storage area(s) 141, other such systems suitable for pipe racking and manipulation as known in the art can be converted as taught herein into a centralized setback and racking system of an MODS of this disclosure. It will be readily apparent to one of skill in the art, upon reading this disclosure, that a variety of apparatus can be utilized in a centralized setback and racking system according to this disclosure.

The lowered and centralized setback and racking system of this disclosure can be configured in any suitable configuration. For example, in embodiments, a cross-section of a lowered and centralized setback and racking system of this disclosure is, without limitation, substantially rectangular, square, circular or oval. In embodiments, the setback and racking system is a rotatable system, allowing for pipe racking support of all wellbays along the wellbay access perimeter.

Traditional setbacks hold about 20,000 feet of drillpipe. In embodiments, a setback of this disclosure is substantially larger than a traditional setback, as it is no longer being positioned by and thus need support from the drilling module(s) and is, in embodiments disclosed herein, at least partially sheltered from the wind. The lowering of the setback and racking system wherein the lowered setback and racking system is fixed but configured for rotational movement of tubulars allowing for alignment and support for tubular handling and racking can desirably lower the center of gravity of the platform, resulting in increased platform stability. Lowering the setback simplifies the drilling system zone management and, in embodiments, a system of this disclosure can be designed to handle Range 3 triple lengths, rather than being limited to the traditional Range 2 triples.

It is noted that, for onshore drilling operations, a central setback and racking system of this disclosure, while dissociated from the drilling rig or module, may be positioned on an upper deck (rather than wholly or substantially below it). In embodiments, a setback and racking system of an onshore (or offshore) multi-operational drilling system is disassociated and removed from the mast or derrick of a drilling module or rig and is configured for substantially horizontal storage of tubulars.

Peripheral Skidding System 120.

In embodiments, the multi-operational drilling system of this disclosure comprises, in addition to a plurality of wellbay accesses located along a wellbay access perimeter (that, in embodiments, surrounds a lowered setback and racking system), one or more skidding systems 120 configured to enable movement of drilling module(s) along a set skidding perimeter (that may also surround a lowered setback and racking system 140 which may be located substantially in the center of a drilling platform 160).

Peripheral skidding system 120 may be coupled to a platform 160 and is operable to position individual equipment skids or drilling modules 150 to allow for access to multiple wellbore accesses arrayed in a wellbay access perimeter that may substantially surround a lowered setback and racking system 140 (which lowered setback and racking system 140 is, in embodiments, located at or near the center of the platform). Such a peripheral skidding system enables a plurality of operations to occur simultaneously. Although the systems and methods of this disclosure are described herein for the purposes of clarity and brevity in terms of forming a wellbore (e.g., drilling), as is known in the art, forming of a wellbore may comprise many operations such as, but not limited to, drilling with pipe (e.g., drillpipe, casing, liners), driving pipe, setting and hanging casing (e.g., liners), cementing, gravel packing, logging, measuring with sensors, production testing, injection testing, formation testing, formation stimulation, workover tasks, intervention tasks, offline standbuilding, and other operations associated with or disparate from the foregoing tasks. The peripheral skidding system(s) of an MODS of this disclosure can comprise skids for positioning any of the innumerable types of equipment associated with any combination of these tasks, whether or not specifically recited herein.

As mentioned hereinabove, a peripheral skidding system can be used to enable a plurality of drilling operations to be performed simultaneously. The plurality of operations can be selected from the group consisting of drilling, workover, and intervention and offline standbuilding operations, among others. Workover and intervention operations include, without limitation, wireline, slickline, and coiled tubing. The equipment skids can be aligned and designed so as to allow access to the wellbays individually or to allow simultaneous and multiple access and operation.

As discussed further hereinbelow, peripheral skidding system 120 is operable to position a variety of drilling modules over the wellbay accesses as desired. For example, by way of non-limiting example, the peripheral skidding system 120 can be operable to position one or more drilling modules selected from the group consisting of drilling rigs, offline standbuilding modules, wireline units, coil tubing units, intervention skids, and workover units. The individual drilling modules are further discussed in the following section and comprise, in embodiments, offline standbuilding, drilling, coil tubing, wireline, and workover modules. The peripheral skidding system 120 can position, for example via rails, various skid-mounted drilling modules along a skidding perimeter that may be centered about a lowered setback and racking system 140.

In embodiments, peripheral skidding system 120 comprises a track comprising at least one or a pair of spaced apart rails 125*a*/125*b* which are parallel to one another in the illustrated embodiments and can surround a central setback and racking system. In embodiments, the rails define a skidding perimeter having substantially the same shape as the shape of the perimeter defined by the plurality of wellbay accesses. In embodiments, the rails define a skidding perimeter having a different shape from the wellbay access perimeter shape defined by the plurality of wellbay accesses. In embodiments, at least one rail of the peripheral skidding system 120 is located a greater average horizontal distance from a central setback and racking system than the average distance of the wellbays therefrom. In embodiments, both rails of a peripheral skidding system are located a greater average horizontal distance from the central setback and racking system than the average distance of the wellbays therefrom. Rails 125*a*/125*b* may be oriented in different configurations, such as and without limitation to, oval, circular, triangular, rectangular, square, hexagonal, octagonal, pentagonal, and the like. One or more skids are moveably disposed on each peripheral skidding system 120.

In embodiments, an MODS of this disclosure comprises at least one peripheral skidding system comprising at least two rails positioned substantially equidistantly apart, wherein each of the at least two rails defines a skidding perimeter surrounding a setback and racking system. The peripheral skidding system 120 is desirably capable of moving drilling module skids along the skidding perimeter and orienting each specific equipment system or drilling module above any desired wellbore. Each skid or drilling module can be operated independently of the others and has access to each wellbore via the corresponding wellbay access thus allowing for multiple operations to overlap in time.

As mentioned previously hereinabove, in embodiments, an MODS further comprises at least one peripheral skidding system operable to serially position a drilling module above at least a fraction of wellbays. In embodiments, an MODS comprises a first peripheral skidding system operable to serially position a drilling module above at least a fraction of a first set of wellbays and a second peripheral skidding system operable to serially position a drilling module above at least another fraction of the first set of wellbays.

In embodiments in which MODs comprises a second set of wellbay accesses positioned along a second wellbay access perimeter, wherein each of the second set of wellbay accesses is associated with a wellbay substantially therebelow, the system can further comprise at least one peripheral skidding system operable to serially position a drilling module above at least a fraction of the first set of wellbays, at least a fraction of the second set of wellbays or at least a fraction of the first and second sets of wellbays. In other embodiments in which an MOD comprises a second set of wellbay accesses positioned along a second wellbay access perimeter, wherein each of the second set of wellbay accesses is associated with a wellbay substantially therebelow, the system further comprising at least two peripheral skidding systems, wherein a first peripheral skidding system is operable to serially position a drilling module above at least a fraction of the total wellbays comprising the first and second sets of wellbays and wherein the second peripheral skidding system is operable to serially position a drilling module above at least another fraction of the total wellbays.

Drilling Modules 150.

An MODS of this disclosure can further comprise one or more operational drilling modules 150. The operational drilling modules, skids, or systems can be any systems known in the art for performing operations on a drilling platform. For example, in embodiments, the one or more drilling modules are selected from the group consisting of drilling rigs, offline standbuilding modules, wireline units, coil tubing units, intervention skids, and workover units. In embodiments, the individual skidding systems constitute offline standbuilding, drilling, coil tubing, wireline, and workover operations and are moveable on the rails of a peripheral skidding system operable to orient each specific equipment system with a desired wellbore. Each system can thus be operated independently of the others and has access to each wellbore, thus allowing for simultaneous multiple operations to occur.

For clarity, all components of the drilling modules are not depicted in the drawings herein or discussed in detail hereinbelow, but such components will be readily apparent to one of skill in the art. In embodiments, an MODS of this disclosure comprises at least two operating drilling modules selected from the group consisting of standbuilding systems, wireline units, coiled tubing units, workover systems, intervention units, and drilling rigs. An MODS of this disclosure can comprise two, three, four, or more operating drilling modules. The number of drilling modules that can be functioning simultaneously is limited only by the capacity of the drawworks, the number of wellbay accesses, and/or the ability of the platform to meet the requirements of the equipment systems and less so than conventional systems by the positioning of the drilling modules. This is because the perimeter positioning of the wellbays and wellbay accesses, as opposed to the traditional grid (e.g., 4×4 matrix) layout and central wellbays and wellbay accesses, enables simultaneous access to multiple wellbays. The multi-operational drilling systems of this disclosure allow substantial improvements over conventional drilling rig designs, which traditionally utilize a matrix wellbay access format, thus limiting the drilling rig to serially performed operations. For example, with conventional matrix wellbay layouts, drilling, wireline, workover and/or coil tubing are performed one at a time, not simultaneously. Positioning of the drilling, offline standbuilding, wireline, coil tubing, and workover systems on a peripheral skidding system(s) according to embodiments of this disclosure allows movement (for example, on rails) along a set perimeter around a central setback and racking system.

Drilling rigs or modules are known in the art. A drilling module generally comprises a mast or derrick, a top drive, a driller's cabin, a drilling floor, and various other associated drilling equipment utilized for drilling operations. In embodiments, an MODS of this disclosure further comprises or is operable with a drilling rig that does not comprise a setback and racking system. In embodiments, the MODS of this disclosure comprises a drilling rig comprising a mast. In embodiments, the MODS of this disclosure comprises a drilling rig comprising no derrick. The disassociation of the setback and racking system from the drilling rig that is afforded via the MODS of embodiments of this disclosure enables, in embodiments, drilling operations to be performed with a relatively lightweight mast or derrick, as the weight and space incurred by conventionally-located (i.e. within the derrick itself) setbacks and racking systems are removed.

Offline standbuilding modules are known in the art and offline standbuilding modules can be any package of equipment operable to build stands. Offline standbuilding apparatus can comprise, for example a hoisting system and mousehole for the manipulation of tubular and a system for making-up of tubular, i.e. iron roughneck.

Coiled tubing modules are known in the art and a coiled tubing module can be any package of equipment required to run a coiled tubing operation. Coiled tubing apparatus can comprise, for example, some combination of a coiled tubing reel to store and transport a coiled tubing string, an injector head to provide the tractive effort to run and retrieve the coiled tubing string, a control cabin from which the equipment operator controls and monitors the operation, a power pack that generates the necessary hydraulic, and pneumatic power required by the other components. The dimensions and capacities of the coiled tubing unit components determine the size and length of coiled tubing string that can be used on the unit. Pressure-control equipment may be incorporated into the equipment to provide the necessary control of well pressure fluid during normal operating conditions and contingency situations requiring emergency control.

In the embodiment of FIGS. 1*a*/1*b*, system 110 comprises first operational drilling module 150*a*, and second operational drilling module 150*b*. In the embodiment of FIGS. 1*a* and 1*b*, first operational drilling module 150*a* is an offline standbuilding module comprising equipment utilized for offline standbuilding while second operating drilling module 150*b* is a drilling rig. Because the setback and racking system 140 has been disassociated and removed from the drilling rig, in embodiments, drilling rig 150*b* is substantially smaller and lighter than a conventional drilling rig containing an integrated setback. In the embodiment of FIGS. 1*a*/1*b*, drilling module 150*b* comprises mast 251, crown block 152, top drive 153, driller's cabin 254 and various other associated drilling equipment utilized for drilling operations. For clarity, all components of the modules 150*a*/150*b* are not depicted in the drawings herein, but such components will be readily apparent to one of skill in the art.

Although FIG. 1 depicts the first drilling module 150*a* (i.e. offline standbuilding) located opposite or across from the second drilling module 150*b* (i.e. drilling rig), one of skill in the art will appreciate that the first and second drilling modules can be positioned (e.g., by the peripheral skidding system 120) over any two of the wellbay accesses, limited only by the size of the drilling modules themselves and the footpad available for the various operations based on the spacing of the wellbay accesses around wellbay access perimeter 131.

MODS 110 enables offline standbuilding 150*a* to build and lower a variety of tubulars, including but not limited to doubles, triples or quads (2, 3, or 4 pieces of pipe pre-assembled in continuous lengths) while the drilling rig 150*b* performs simultaneous drilling operations. Such a system greatly enhances the overall efficiency of a drilling platform. The ability to build stands at one location while drilling at another can greatly improve the efficiency of a drilling platform, enabling more rapid tripping into the hole (wellbore) utilizing doubles, triple or quads. Also, as mentioned hereinabove, the incorporation of a lowered setback and racking system 140 reduces the complexity of rig floor operations by relegating only drilling operations to drillfloor 158 while eliminating the need for a retract dolly and allowing for the more efficient handling of tubulars. The ability to utilize multiple modules reduces costs and increases efficiency in a number of ways. For example, the system provides for elimination of the time to retrieve and break-out and rack the drillstring from the wellbore, while building and racking casing thus eliminating 50% of the connection time and performing this action simultaneously as the drilling module is tripping out of the hole. The increased efficiency and reduced elapsed time between drilling and performing casing operations is a significant improvement.

In the embodiment of FIGS. 1*a* and 1*b*, wellbores are shown being serviced with blowout preventers 156, riser tensioners 157 and dry trees 155. One of skill in the art will readily appreciate that the equipment being utilized to service/drill the wellbores will vary depending on the stage of operations and will understand that the system and methods of this disclosure are not limited thereby. For example, by way of non-limiting example, in embodiments, an MODS of this disclosure may be operable with wet trees. As mentioned hereinabove, in embodiments, one or more wellbay accesses of a MODS of this disclosure is sized such that a dry tree, a wet tree, a surface stack blowout preventer (BOP) and/or a subsea stack BOP can be run therethrough.

As mentioned hereinabove, the disclosed MODS can be integrated with or further comprise a platform 160, including, without limitation, drillships, barges, fixed or unfixed platforms, submersible platforms, semi-submersible platforms, tension-leg platforms and spars. In FIGS. 1-6, platform 160 is depicted as a spar. Although the depictions of FIGS. 1-6 illustrate embodiments in which the MODS is incorporated with a spar-type drilling platform 160 having three decks, upper or main deck 161, mezzanine or second deck 162 and lower deck 163 above water line 170, pipe deck 190 and central spar 183, this is in no way intended to limit the MODS of this disclosure to utilization with a specific type of platform. As discussed further hereinbelow, the specific type of platform (i.e. Spar, TLP, etc.) utilized with the MODS of this disclosure is not intended to be limited to those shown in the drawings. One of skill in the art will readily understand the applicability of the disclosed MODS to a multitude of drilling platforms. The MODS of this disclosure will be adaptable, as well, to new types of drilling platforms not yet invented.

Figure 3B:
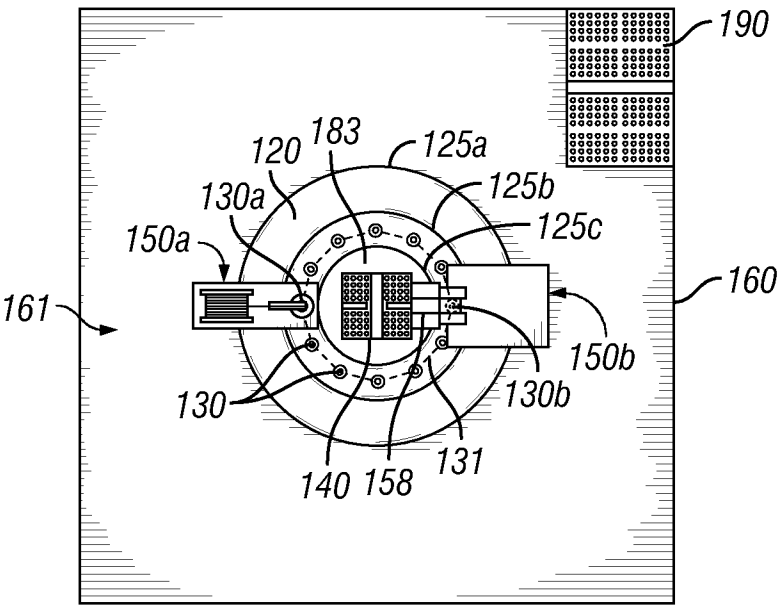
FIG. 3*b* is a top view of the multi-operational drilling system of FIG. 3*a;*
Figure 3A:
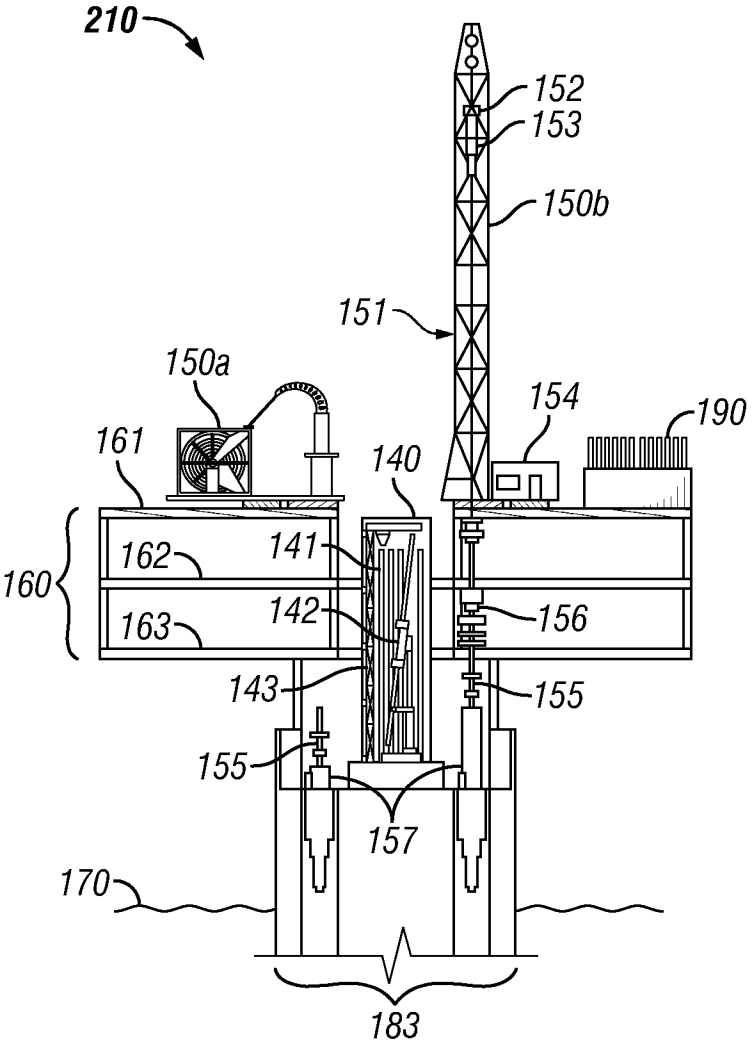
FIG. 3*a* is a side view elevation of a multi-operational drilling system according to another embodiment of this disclosure, the multi-operational drilling system comprising a first drilling module, a second drilling module, and a lowered setback and racking system.

FIG. 3*a* is a side view of an MODS 210 according to another embodiment of this disclosure, and FIG. 3*b* is a top view of MODS system 210 of FIG. 3*a*. The first drilling module 150*a* of MODS 210 is a coiled tubing skid, while second drilling module 150*b* is a drilling rig. Also indicated are a lowered setback and racking system 140 and a peripheral skidding system 120. In this embodiment, MODS 210 is configured for drilling to be performed via drilling module 150*b* simultaneously with coiled tubing via first drilling module 150*a*. The embodiment of FIGS. 3*a*/3*b* enables drilling and coiled tubing operations to be performed simultaneously.

Figure 4B:
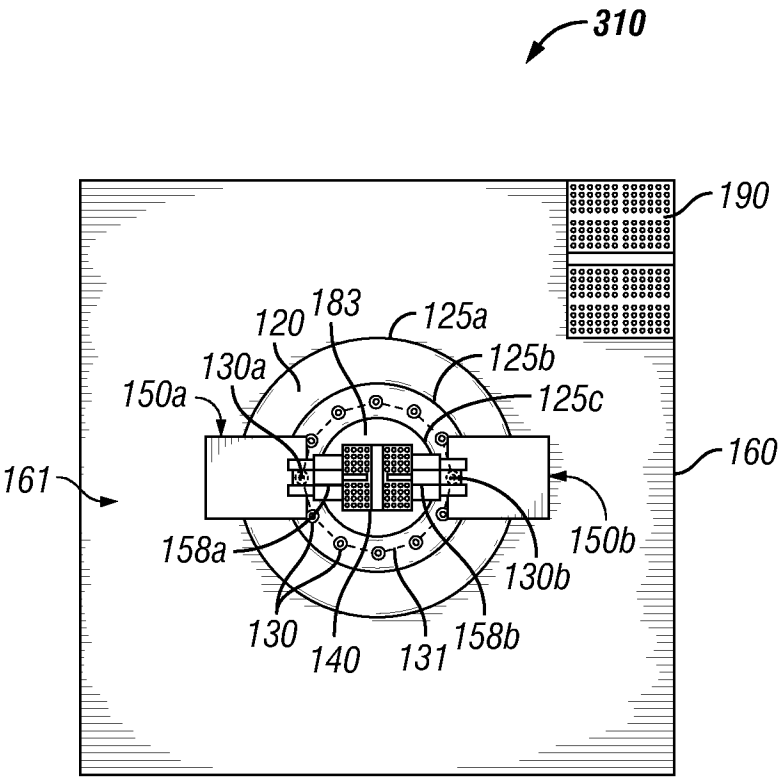
FIG. 4*b* is a top view of the multi-operational drilling system according to the embodiment of FIG. 4*a;*
Figure 4A:
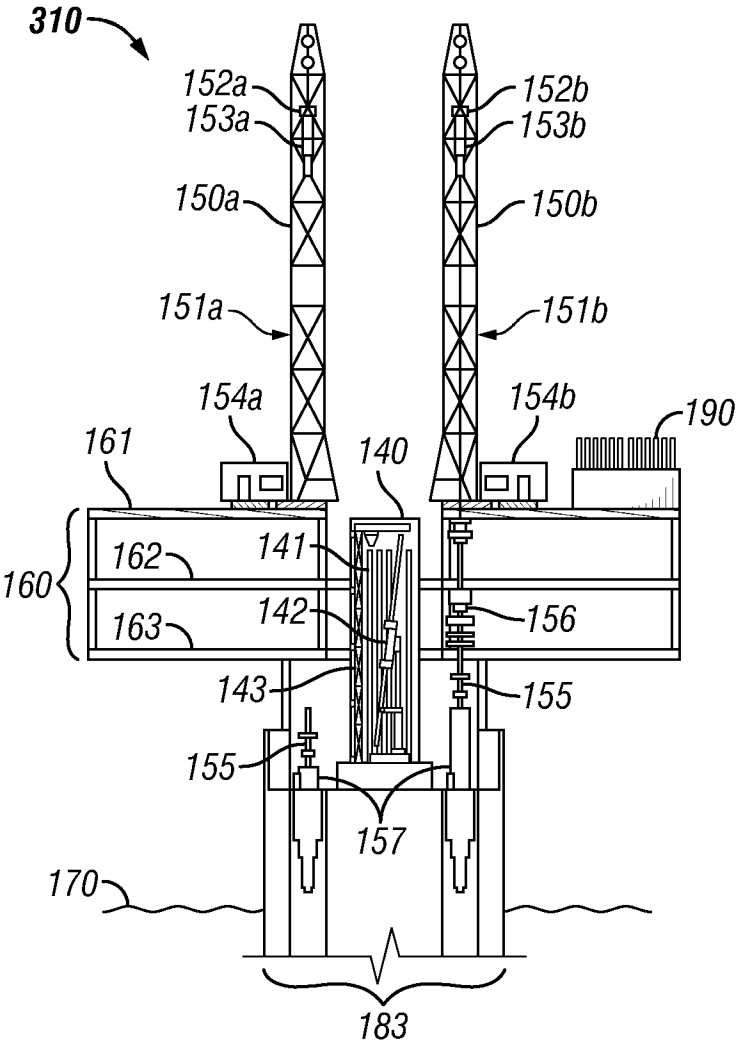
FIG. 4*a* is a side view elevation of a multi-operational drilling system according to another embodiment of this disclosure, the multi-operational drilling system comprising a first drilling module, a second drilling module, and a lowered setback and racking system.

FIG. 4*a* is a side view of an MODS 310 according to another embodiment of this disclosure, and FIG. 4*b* is a top view of MODS system 310 of FIG. 4*a*. First and second drilling modules 150*a* and 150*b* of MODS 310 are drilling rigs. In this embodiment, MODS 310 is a multi-drilling system configured for a drilling rig or system of first drilling module 150*a* to operate simultaneously with a second drilling system or rig of second drilling module 150*b*. Again, MODS 310 enables dual operations to be performed simultaneously. Also indicated in FIGS. 4*a*/4*b* are a lowered setback and racking system 140 and a peripheral skidding system 120.

Figure 5B:
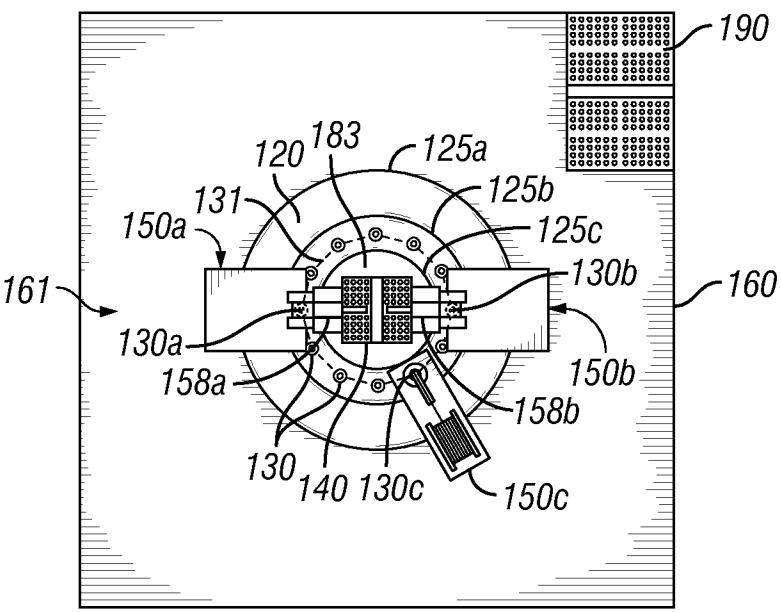
FIG. 5*b* is a top view of the multi-operational drilling system of FIG. 5*a;*
Figure 5A:
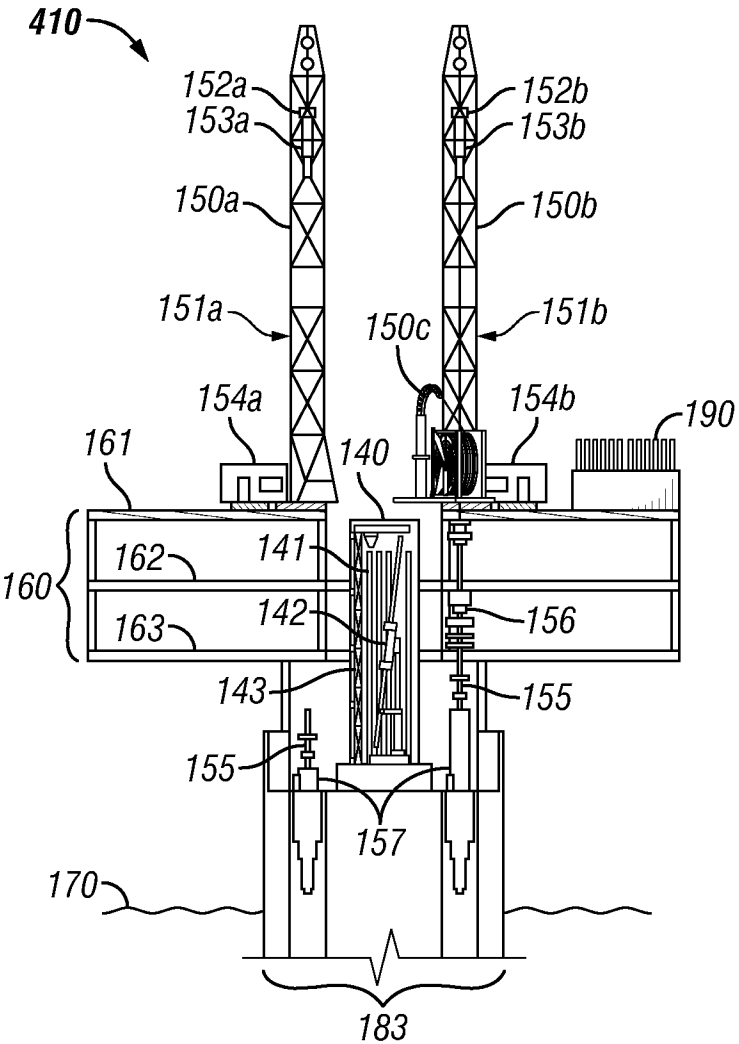
FIG. 5*a* is a side view elevation of a multi-operational drilling system according to an embodiment of the present disclosure, the drilling system comprising a first drilling module, a second drilling module, a third drilling module, and a lowered setback and racking system.

FIG. 5*a* is a side view of an MODS 410 according to another embodiment of this disclosure, and FIG. 5*b* is a top view of MODS system 410 of FIG. 5*a*. MODS 410 comprises, in addition to first drilling module 150*a* and second drilling module 150*b*, a third drilling module 150*c*. First and second drilling modules 150*a*/150*b* of MODS 410 are drilling rigs, while third drilling module 150*c* is a coiled tubing skid. In this embodiment, MODS 410 is configured for coiled tubing operations to take place via coiled tubing module 150*c* while drilling systems 150*a* and 150*b* are also operating. The embodiment of FIGS. 5*a*/5*b* enables multiple (i.e. three) operations to be performed simultaneously. Also indicated in FIGS. 5*a*/5*b* are a lowered setback and racking system 140 and a peripheral skidding system 120.

Figure 6B:
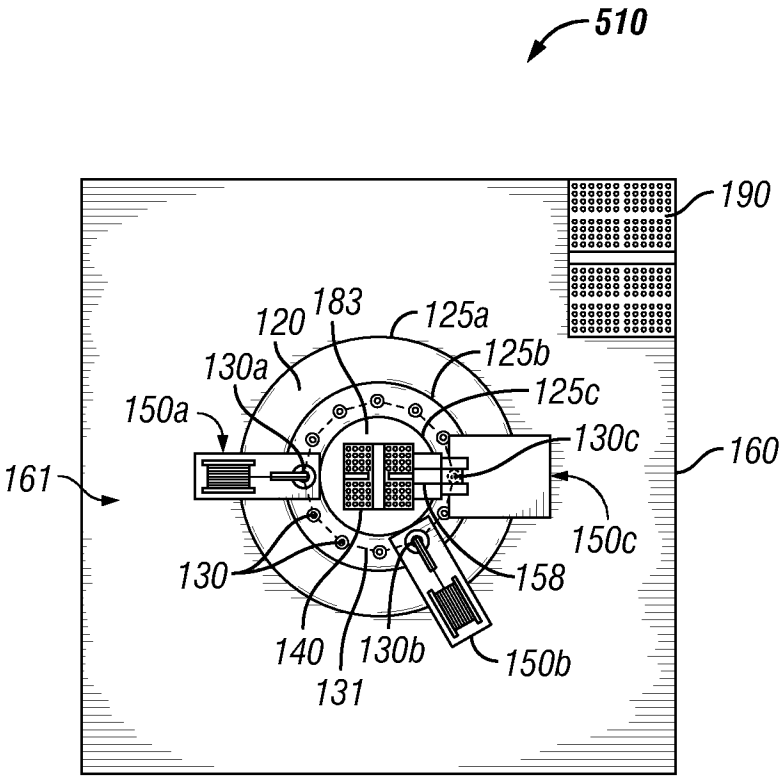
FIG. 6*b* is a top view of the multi-operational drilling system of FIG. 6*a*.
Figure 6A:
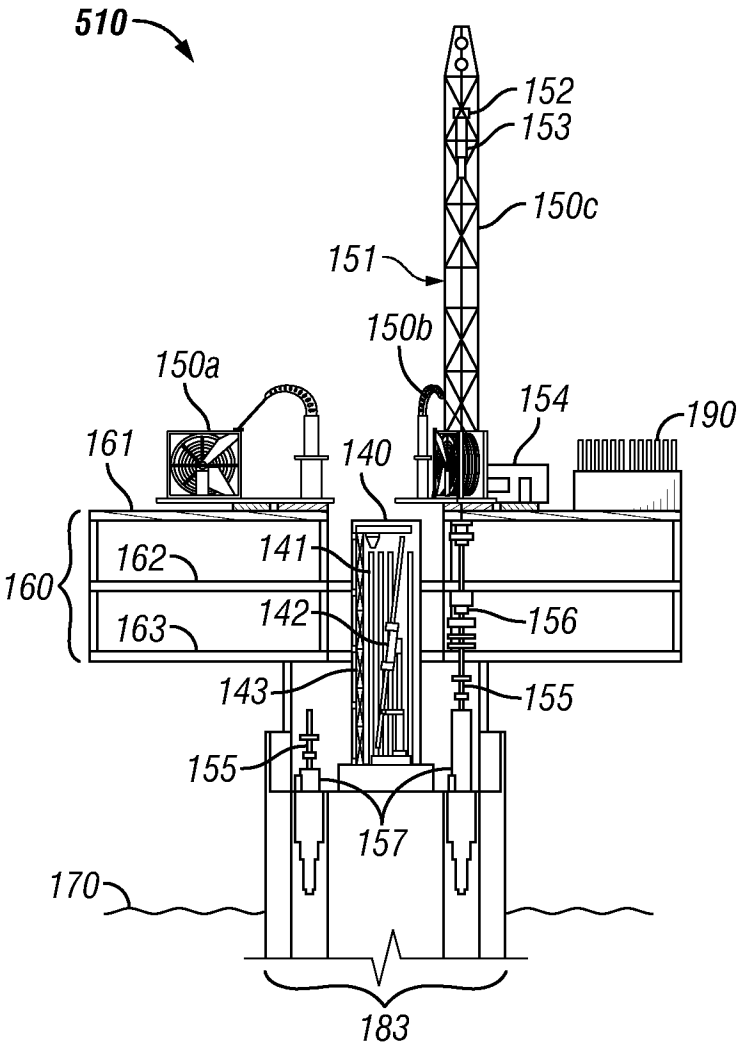
FIG. 6*a* is a side view elevation of a multi-operational drilling system according to another embodiment of this disclosure, the multi-operational drilling system comprising a first drilling module, a second drilling module, a third drilling module, and a lowered setback and racking system.

FIG. 6*a* is a side view of an MODS 510 according to another embodiment of this disclosure, and FIG. 6*b* is a top view of MODS system 510 of FIG. 6*a*. MODS 510 comprises, in addition to first drilling module 150*a* and second drilling module 150*b*, a third drilling module 150*c*. In the embodiment of FIGS. 6*a* and 6*b*, first and second drilling modules 150*a*/150*b* of MODS 410 are coiled tubing platforms, while third drilling module 150*c* is a drilling rig. MODS 510 is configured for coiled tubing operations to take place via coiled tubing first and second drilling modules 150*a* and 150*b* while the drilling system of third drilling module 150*c* is also operating. As with the embodiment of FIGS. 5*a* and 5*b*, the system of FIGS. 6*a*/6*b* enables multiple (i.e. three) operations to be performed simultaneously. Also indicated in FIGS. 6*a*/6*b* are a lowered setback and racking system 140 and a peripheral skidding system 120.

The MODS of this disclosure allows for simultaneous operations to be performed on a drilling platform. Although a drilling system and offline standbuilding are depicted in FIGS. 1*a* and 1*b*, a drilling system and coiled tubing system in FIGS. 3*a* and 3*b*, two drilling systems in FIGS. 4*a* and 4*b*, two drilling systems and a coiled tubing system in FIGS. 5*a* and 5*b* and a drilling system and two coiled tubing systems in FIGS. 6*a* and 6*b*, it will be readily apparent to one of ordinary skill in the art that any number and combination of operating modules can be enabled via the MODS of this disclosure. The realizable combinations are limited only to the number of wellbays and the capability of the platform to meet the requirements of the selected equipment systems. Thus, the design of the platform itself supporting the MODS will be selected to meet the requirements of the systems one desires to operate concomitantly.

In embodiments, the MODS for performing multiple operations comprising of multiple types of drilling comprises at least one peripheral skidding system and method of using the same, for rotational positioning of various types of equipment used in drilling, workover, wireline, and offline standbuilding operations, wherein the peripheral skidding system is positioned in conjunction with the wellbays so as to ensure substantially equal spacing and access to all; a plurality of wellbays thus allowing multiple operations to occur simultaneously; a lowered setback and racking system that results in the lowering of the center of gravity of the platform, increasing the stability of the platform, wherein the lowered setback and racking system is fixed but allows for rotational movement along its axis to allow for alignment and support for tubular handling and racking; and at least one operational drilling system selected from the group consisting of standbuilding, wireline, coil tubing, workover and drilling, wherein the at least one operational system can selectively operate one at a time (serially) or, due to the peripheral skidding system, simultaneously (in parallel).

Drilling Platform 160.

In embodiments of this disclosure, the MODS further comprises a platform. The drilling platform can be selected from the group consisting of fixed platforms, compliant towers, tension leg platforms (TLP's), spars, semi-submersibles, floating drilling, production, storage and offloading facilities (FDPSO's), drill ships, and modified mobile offshore drilling units (MODU's). The wellbay accesses may be located in the upper deck 161 of a platform 160. The platform may comprise two, three or more decks. In the embodiments shown in FIGS. 1, and 3-6, the platform comprises a spar platform comprising three decks (upper or main deck 161, mezzanine or second deck 162 and lower deck 163). In embodiments, the platform 160 comprises a spar. In embodiments, the platform 160 comprises a TLP. In embodiments, the platform comprises a jack-up. In embodiments, the platform comprises a semi-submersible. In embodiments, the platform is a drillship. In embodiments, the platform is a FDPSO.

Features and Benefits.

The disclosed MODS provides many benefits, a number of which have been mentioned hereinabove. Utilization of the structure of the platform (e.g., the hull) to protect the drilling package (i.e. by moving the setback and racking system from the top deck/top elevation to the hull) provides for a reduced wind load area. Such a design is particularly beneficial for use in hurricane zones, improving hurricane response time and improving safety. Because the lowered setback of an MODS according to this disclosure can be sheltered from the wind, hurricane preparation is simplified. Laying down of a mast or derrick is substantially easier when pipe does not have to be removed therefrom and tied to the deck.

Moving the setback and racking system inside the structure (e.g., inside a hull) shelters it and reduces the number, size and complexity of components remaining on the deck. For example, in embodiments, the only elements of the drilling package that remain on the deck are a drilling module and offline stand building. Lowering the heavy setback and racking package to the structure (e.g., inside a hull) and even, in embodiments, obviating the need for a derrick, provides for a reduced center of gravity. Traditionally, derricks having heights of up to 145 feet or more and footpads on the range of 40 feet by 40 feet and positioned about 60 feet above the upper deck have been utilized for drilling. In embodiments, an MODS of this disclosure comprises a derrick of smaller size or is operable with no derrick at all, the derrick being replaced by, for example, an open-faced or other mast having substantially smaller size than conventional a derrick. This provides for a smaller and less complex drill floor. Because the setback and racking system is removed from the drilling rig, the drilling rig no longer needs to be configured for storage of drill pipe, providing for drilling packages of substantially reduced weight. In embodiments, the disclosed MODS also provides for utilization of a platform with a smaller than conventional hull. By disassociating the setback and racking system from the drilling rig, the racking system and the drilling module (that handle racking and pipe handling; and drilling operations, respectively) can each work independently. This separation of the setback and racking system from the drilling rig provides for enhanced efficiency of drilling operations.

In embodiments, an MODS of this disclosure provides for increased safety and efficiency and redundancy, thus increasing uptime. In embodiments, for example, an MODS of this disclosure reduces tripping time by 5%-20%, 10%-20% or 10%-15% relative to tripping with a traditional spar, by enabling tripping with doubles or triples.

Multi-Operational Drilling Method.

Also disclosed herein is a method of drilling whereby multiple operations associated with drilling can be performed at least substantially simultaneously. The disclosed drilling method comprises peripheral drilling, rather than the conventional centralized or overhead drilling. As mentioned hereinabove, positioning of the wellbay accesses around (surrounding, but not necessarily circular) a lowered setback and racking system 130 and utilization of a peripheral skidding system as disclosed hereinabove provide significant benefits relative to traditional X-Y systems, in which approach to the various wellbay accesses is restricted. Via the disclosed perimeter drilling method, necessary equipment simply moves along the skidding perimeter of a peripheral skidding system until it reaches the wellbay access of the well slot or riser to be serviced. For example, a drilling rig may be positioned above a first wellbay and utilized to drill/complete a wellbore for the production of oil, gas, or water injection while a second drilling module is utilized to service a second wellbay. The drilling rig can be utilized for the drilling and completion of the wellbore associated with that wellbay for the production of oil, gas or water injection. Upon completion of the drilling operation (e.g., upon completion of the well), the drilling rig can be skidded along the rails of the peripheral skidding system to a subsequent wellbay/wellbore. In embodiments, the disclosed system and method enable a drilling rig or system to continue its drilling program while other operations are performed. For example, once the drilling rig has completed operations on a wellbay and moved along to a subsequent wellbay, a drilling modules such as wireline or coiled tubing can be positioned by the peripheral skidding system proximate to the wellbay just serviced by the drilling rig while the drilling rig is operating on the subsequent wellbay. Unlike a standard drilling rig which must reposition back over previously drilled wellbores to conduct workover operations, the system and method of this disclosure allow workover operations of one wellbore to occur at least partially simultaneously with drilling and completions of another wellbore. For example, drilling can be effected on a first wellbay while wireline, coiled tubing, running of pigs, or another operation is performed on one or more other wellbays. The disclosed MODS allows each equipment system (i.e. skid) to operate independently of the others, whether conducting drilling, coil tubing, wireline or workover operations.

In embodiments, the disclosed drilling method comprises aligning each of at least two drilling modules with a wellbay access via a peripheral skidding system as described hereinabove and operating a first of the at least two drilling modules to perform a first operation and a second of the at least two drilling modules to perform a second operation, such that the first and second operations at least partly overlap in time. In embodiments, the disclosed drilling method comprises aligning each of at least three drilling modules with a wellbay access via a peripheral skidding system as described hereinabove and operating a first of the at least three drilling modules to perform a first operation, a second of the at least three drilling modules to perform a second operation, and a third of the at least three drilling modules to perform a third operation, such that at least two of the three operations at least partly overlap in time. In embodiments, portions of each of the three operations are performed such that they overlap (at least partially) in time with the performing of each of the other two operations.

In embodiments, first and second operations selected from the group consisting of drilling operations, workover operations, intervention operations, and offline standbuilding operations are performed at least partly simultaneously. In embodiments, at least one of the first and second operations is selected from wireline, slickline and coiled tubing. For example, in the embodiment of FIGS. 1*a* and 1*b*, offline standbuilding is performed on a first wellbay with offline standbuilding first module 150*a* while drilling is performed on a second wellbay with drilling rig second module 150*b*. In the embodiment of FIGS. 3*a* and 3*b*, coiled tubing is performed on a first wellbay with coiled tubing first module 150*a* while drilling is performed on a second wellbay with drilling rig second module 150*b*. In the embodiment of FIGS. 4*a* and 4*b*, drilling is performed on a first wellbay with drilling rig first module 150*a* while drilling is also performed on another wellbay with drilling rig second module 150*b*. In the embodiment of FIGS. 5*a* and 5*b*, drilling is performed on a first wellbay with drilling rig first module 150*a* while drilling is also performed on another wellbay with drilling rig second module 150*b* and coiled tubing is performed on a third wellbay with a coiled tubing platform of third module 150*c*. In the embodiment of FIGS. 6*a* and 6*b*, coiled tubing is performed on a first wellbay with first module 150*a* and a second wellbay with second module 150*b* while drilling is also being performed on a third wellbay with a drilling rig of third module 150*c*.

In embodiments, at least one of the drilling operations comprising drilling with a drilling rig. In embodiments, the drilling rig does not comprise a setback. In embodiments, casing is built offline and racked into the setback while drilling is being performed on a wellbay.

In embodiments, the method further comprises feeding tubulars to at least one of the operating drilling modules via a centralized setback and racking system. In embodiments, the method further comprises feeding tubulars to at least one of the other drilling modules via the central setback and racking system.

In embodiments, the method further comprises aligning at least one of the at least two drilling modules with a different wellbay access via the peripheral skidding system, aligning at least one additional drilling module with a wellbay access, or both and feeding tubulars to at least one of the at least two drilling modules, the additional modules, or both via the central setback and racking system.

In embodiments, the method comprises running a dry tree, a wet tree, a surface stack blowout preventer (BOP) and/or a subsea stack BOP through at least one wellbay access.

While preferred embodiments of the invention have been shown and described, modifications thereof can be made by one skilled in the art without departing from the spirit and teachings of the invention. Those skilled in the art should realize that such equivalent constructions do not depart from the spirit and scope of the invention, and that they may make various changes, substitutions and alterations herein without departing from the spirit and scope of the invention. The embodiments described herein are thus exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, and so forth). Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of and the like.

Accordingly, the scope of protection is not limited by the description set out above but is only limited by the claims which follow, that scope including all equivalents of the subject matter of the claims. The term 'comprising' within the claims is intended to mean 'including at least' such that the recited listing of elements in a claim are an open group. The terms 'a,' 'an' and other singular terms are intended to include the plural forms thereof unless specifically excluded. Each and every claim is incorporated into the specification as an embodiment of the present invention. Thus, the claims are a further description and are an addition to the preferred embodiments of the present invention. The disclosures of all patents, patent applications, and publications cited herein are hereby incorporated by reference, to the extent they provide exemplary, procedural or other details supplementary to those set forth herein.

What is claimed is:

1. A system comprising:

a setback and racking system having a center axis;

a first set of wellbay accesses positioned along a wellbay access perimeter that surrounds the center axis, wherein each of the first set of wellbay accesses is associated with a wellbay substantially therebelow, and wherein at least a portion of the setback and racking system is positioned at an elevation lower than the elevation of the wellbay accesses;

a drilling module coupled to a skidding system that is positioned at a level higher than the setback and racking system, wherein the skidding system is operable to rotate the drilling module about the center axis so as to selectively position the drilling module in alignment with each of the first set of wellbay accesses, and wherein the setback and racking system is configured to feed tubulars to the drilling module when the drilling module is in alignment with each of the first set of wellbay accesses.

2. The system of claim 1 comprising at least three wellbay accesses.

3. The system of claim 2 wherein the wellbay access perimeter is substantially triangular.

4. The system of claim 1 comprising at least four wellbay accesses.

5. The system of claim 4 wherein the wellbay access perimeter is substantially rectangular.

6. The system of claim 1 wherein the wellbay access perimeter is substantially a shape selected from the group consisting of triangular, rectangular, circular, oval, and octagonal.

7. The system of claim 1 wherein the wellbay access perimeter substantially surrounds the setback and racking system.

8. The system of claim 1 further comprising at least two operating drilling modules selected from the group consisting of standbuilding systems, wireline units, coiled tubing units, workover systems, intervention units, and drilling rigs.

9. The system of claim 8 wherein the at least two operating drilling modules comprise a drilling rig and wherein the drilling rig does not comprise a setback and racking system.

10. The system of claim 9 wherein the drilling rig comprises a mast.

11. The system of claim 8 comprising no derrick.

12. The system of claim 1, wherein the skidding system is operable to serially position the drilling module above at least a fraction of the first set of wellbay accesses.

13. The system of claim 12 further comprising a second skidding system operable to serially position the drilling module above at least another fraction of the first set of wellbay accesses.

14. The system of claim 12 wherein the skidding system comprises at least two rails positioned substantially equidistantly apart, wherein each of the at least two rails defines a skidding perimeter surrounding the setback and racking system.

15. The system of claim 1 comprising a second set of wellbay accesses positioned along a second wellbay access perimeter, wherein each of the second set of wellbay accesses is associated with a wellbay substantially therebelow.

16. The system of claim 15, wherein the skidding system is operable to serially position the drilling module above at least a fraction of the first set of wellbay accesses, at least a fraction of the second set of wellbay accesses or at least a fraction of the first and second sets of wellbay accesses.

17. The system of claim 15 further comprising a second skidding system operable to serially position the drilling module above at least a fraction of the second set of wellbay accesses.

18. The system of claim 15 wherein the second set of wellbay accesses is radially staggered relative to the first set of wellbay accesses.

19. The system of claim 1 wherein the wellbay accesses are located in the upper deck of a drilling platform.

20. The system of claim 19 wherein the drilling platform is selected from the group consisting of fixed platforms, compliant towers, tension leg platforms (TLP's), spars, semi-submersibles, floating drilling, production, storage and off-loading facilities (FDPSO's), drill ships, and modified mobile offshore drilling units (MODU's).

21. A system comprising:

a centrally located setback and racking system;

a set of wellbay accesses positioned substantially equidistantly apart from each other along a wellbay access perimeter, each of the plurality of wellbay accesses associated with a wellbay substantially therebelow;

at least one peripheral skidding system located on a main deck of a drilling platform, wherein the at least one peripheral skidding system is operable to position a plurality of drilling modules with a plurality of the wellbay accesses, wherein the centrally located setback and racking system is positioned at least partially below the elevation of the peripheral skidding system, and wherein the centrally located setback and racking system is configured for rotational movement about its center of axis to feed tubulars in substantially the direction of each of the plurality of wellbay accesses.

22. The system of claim 21 wherein the wellbay access perimeter at least substantially surrounds the centrally located setback and racking system.

23. The system of claim 21 further comprising a plurality of drilling modules selected from the group consisting of drilling rigs, workover rigs, wireline units, offline standbuilding systems, and combinations thereof.

24. The system of claim 23 comprising at least one drilling rig and at least one coiled tubing unit.

25. The system of claim 23 comprising at least two drilling rigs.

26. The system of claim 21 wherein the drilling platform is selected from the group consisting of fixed platforms, compliant towers, tension leg platforms (TLP's), spars, semi-submersibles, floating drilling, production, storage and off-loading facilities (FDPSO's), drill ships, and modified mobile offshore drilling units (MODU's).

27. A method of drilling, the method comprising:

aligning each of at least two drilling modules with a respective wellbay access via a peripheral skidding system operable to position a plurality of drilling modules proximate a plurality of wellbay accesses, wherein the plurality of wellbay accesses is aligned in a wellbay access perimeter and wherein each wellbay access is associated with a wellbay substantially therebelow; and operating the first of the at least two drilling modules to perform a first operation and the second of the at least two drilling modules to perform a second operation, wherein at least a portion of the first and second operations are performed simultaneously, and wherein the wellbay access perimeter at least substantially surrounds a central setback and racking system that is configured to feed tubulars to each of the at least two drilling modules.

28. The method of claim 27, wherein the first and second operations are selected from the group consisting of drilling operations, workover operations, intervention operations, and offline standbuilding operations.

29. The method of claim 28, wherein at least one of the first and second operations is selected from the group consisting of wireline, slickline, and coiled tubing.

30. The method of claim 29, wherein at least one of the first and second drilling modules comprises a drilling rig.

31. The method of claim 30, wherein the drilling rig does not comprise a setback.

32. The method of claim 27 comprising aligning each of at least three drilling modules.

33. The method of claim 27, wherein the peripheral skidding system is located on a drilling platform selected from the group consisting of fixed platforms, compliant towers, tension leg platforms (TLP's), spars, semi-submersibles, floating drilling, production, storage and offloading facilities (FDPSO's), drill ships, and modified mobile offshore drilling units (MODU's).

34. The method of claim 33, wherein the peripheral skidding system is located on a main deck of the drilling platform and wherein the setback and racking system is positioned at least partially below the main deck.

35. The method of claim 27 further comprising feeding tubulars to at least one of the drilling modules via the central setback and racking system.

36. The method of claim 35 further comprising feeding tubulars to at least one of the other drilling modules via the central setback and racking system.

37. The method of claim 27, further comprising aligning at least one of the at least two drilling modules with a different wellbay access via the peripheral skidding system, aligning at least one additional drilling module with a wellbay access, or both, and feeding tubulars to at least one of the at least two drilling modules, the additional modules, or both, via the setback and racking system.

38. The method of claim 27 wherein at least one operation selected from the group consisting of the first operation and the second operation comprises running a dry tree through at least one of the plurality of wellbay accesses.

39. The method of claim 27 wherein at least one operation selected from the group consisting of the first operation and the second operation comprises running a wet tree through at least one of the plurality of wellbay accesses.

40. The method of claim 27 wherein at least one operation selected from the group consisting of the first operation and the second operation comprises running a surface stack BOP through at least one of the plurality of wellbay accesses.

41. The method of claim 27 wherein at least one operation selected from the group consisting of the first operation and the second operation comprises running a subsea stack BOP through at least one of the plurality of wellbay accesses.

* * * * *